US007445086B1

(12) United States Patent
Sizemore

(10) Patent No.: US 7,445,086 B1
(45) Date of Patent: Nov. 4, 2008

(54) LADDER LOCK

(76) Inventor: Daniel Sizemore, 5365 Shen Ave., Jacksonville, FL (US) 32205

( * ) Notice: Subject to any disclaimer, the term of this patent is extended or adjusted under 35 U.S.C. 154(b) by 0 days.

(21) Appl. No.: 11/653,619

(22) Filed: Jan. 16, 2007

(51) Int. Cl.
*E06C 7/42* (2006.01)

(52) U.S. Cl. ..... 182/107; 182/108; 182/11; 182/165

(58) Field of Classification Search ..... 182/107, 182/108, 11, 165, 169
See application file for complete search history.

(56) References Cited

U.S. PATENT DOCUMENTS 4,412,599 A 11/1983 McCrudden et al.
4,632,220 A * 12/1986 Murrell ..... 182/111
4,766,976 A 8/1988 Wallick, Jr.
4,858,725 A 8/1989 Griffin
4,964,488 A 10/1990 Stewart
4,974,699 A 12/1990 Boring
5,085,291 A 2/1992 Narramore
5,590,739 A * 1/1997 High et al. ..... 182/169
5,960,905 A 10/1999 Gardner
6,012,546 A 1/2000 Bee et al.
6,152,261 A * 11/2000 Hoey ..... 182/107
6,681,893 B1 * 1/2004 Coulson ..... 182/107
6,851,518 B1 * 2/2005 Walker ..... 182/107
6,883,642 B2 * 4/2005 Matty ..... 182/117
6,997,283 B2 * 2/2006 Wollenberg et al. ..... 182/214

* cited by examiner

*Primary Examiner*—Katherine Mitchell
*Assistant Examiner*—Candace L. Bradford

(57) ABSTRACT

This is a device that will provide additional security for individuals who work on extension ladders. It can be fit to any extension ladder and provide a support mechanism so that, if the ladder were ever to shift backward, it would stop the ladder from shifting, thereby protecting the worker. Because of the telescoping nature of the tube, it provides protection and it may be used in a variety of settings.

12 Claims, 14 Drawing Sheets

Swivel Insert for Step

LADDER LOCK

BACKGROUND OF THE INVENTION

A. Field of the Invention

This relates to the use of an extension ladder and specifically the safe use of the extension ladder. This is an attachment piece that is attached near the bottom front of the ladder and will safely secure the extension ladder to a structure.

B. Prior Art

There are many other prior art references to ladder devices and specifically ladder devices, which seek to minimize injury as a result of a fall from a ladder. Representative examples of them are many in the prior art, and some attach to the structure and some to buildings. These types of structures can be found in the following representative patents: Bee, et al., U.S. Pat. No. 6,012,545, Boring, U.S. Pat. No. 4,974,669, Gardner, U.S. Pat. No. 5,960,905, and Griffin, U.S. Pat. No. 4,858,725.

None of the prior art references, however, use a device that attaches to the ladder and is then secured by the frame of a structure as contemplated in this device.

BRIEF SUMMARY OF THE INVENTION

Extension ladders are used, for among other purposes, to paint and repair surfaces on buildings. An extension ladder merely allows an individual to remain off the ground and closer to a piece of particular work. Extension ladders are used by, among others, painters, electricians, and carpenters in repairing and installing various fixtures in a house or building.

An extension ladder has essentially two elements. Each element has two parallel sides and a set of rungs on which the person will stand to climb the ladder. One of the elements will slide against the other and will lock in place. The primary safety concern associated with extension ladders is that, once the ladder is on the ground it needs to remain in place as the person goes up and down the ladder. If the ladder slips on the surface below, the individual on the ladder may fall. This is particularly true of the ladder surfaces placed on a tile or wood floor, which tend to be more slippery than traditional carpet or other surfaces, although the ladder can certainly slip on carpeted surfaces as well.

Most, if not all, extension ladders have a non-skid surface on the bottom portion of the ladder element that rests on the floor surface. Sometimes, because of wear, the non-skid surfaces become slick and will allow the ladder to slip backwards and possibly cause injury or death to the worker and/or parts of the house or to the contents of the house.

This is a device, which attaches to the bottom of the extension ladder near the bottom of one of the elements and secures a telescoping pull with a flat rectangular pad on one end. When the extension ladder is positioned, the telescoping pole is rotated away from the ladder. A pad, which may contain weighted material, will be secured against the baseboard or wall of the building.

A clamping mechanism to secure the position of the telescoping tube is also provided to ensure that the tube does not collapse during normal use. The telescoping tube is attached to a T-member, which is a female plug, which is attached to a U-shaped support mechanism that clamps on both legs of the ladder slightly above the non-skid surface and below the first rung of the ladder.

In another embodiment a female threaded portion will be installed on the bottom rung of the extension ladder to secure a swivel mechanism. The male end of the telescoping tube will attach to the swivel mechanism. This ability to swivel will allow the telescoping tube to be positioned in many different places.

For ease of transport, a clip on one rung of the ladder whereby a portion of the telescoping tube will clip onto the ladder to hold the tube in place.

REFERENCE TO NUMBERING

Figure 2:
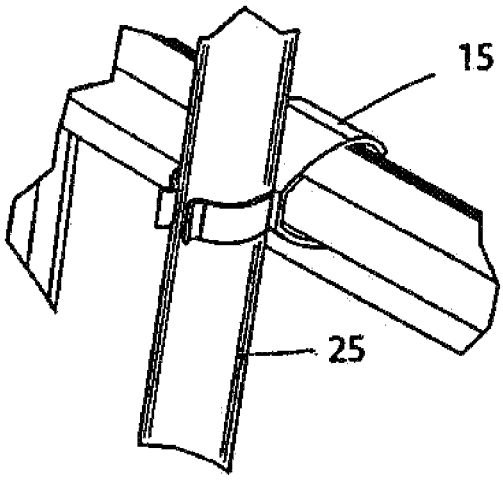
FIG. 2 is an exploded view of number 2 as indicated on FIG. 1.

| | |
|---|---|
| 5 | Device |
| 8 | Foot supports |
| 10 | Extension ladder |
| 10R | Extension ladder movable member |
| 10S | Extension ladder stationary member |
| 15 | Clip |
| 20 | Wall structure |
| 21 | Baseboard |
| 22 | Archway brace |
| 25 | Telescoping pole |
| 27 | Locking mechanism |
| 28 | Double mounting member-U shaped base member |
| 30 | Base |
| 35 | Adjustable Tee |
| 36 | Connection means for the tee |
| 40 | Adjustable width support structure |

-continued

| | |
|---|---|
| 45 | Clamping mechanism |
| 50 | Clamp bolt |
| 55 | Female portion of rung attachment for ladder |
| 57 | Flexible portion of rung attachment |
| 59 | Swivel for rung attachment |
| 60 | Rung attachment |

DETAILED DESCRIPTION OF THE EMBODIMENTS

This device 5 is a safety device to be used with an extension ladder 10. The extension ladder has two pieces, one section rests on the floor and has a series of foot supports 8 and remains stationary. These foot supports 8 will rest on the ground surface during normal use. The other section will move parallel to the stationary member of the extension ladder.

When the ladder is initially being positioned one section of the ladder will move up and down while the other section stays stationary. One section 10R will go up and down relative to the stationary portion 10S. This device will be clamped to the bottom of section 10S slightly above the foot supports 8 and below the first ladder rung. It is secured to the ladder member with a clamping mechanism 45, which take the general shape of a "U". Various types of clamps may be used and the means to secure the clamping mechanism 45 to the extension ladder may include bolts as well as eye screws.

Two solid support structure 40 members will extend outward from the clamping mechanism 45 and will be joined at a tee 35. The tee will be equipped with a female end into which the male end of a telescoping tube will be inserted. One end of a telescoping tube 25 will be inserted into the one female end of the tee 35. This may be threaded or it may be a molded as part of the device itself.

A means to secure 27 the tube will allow the sections of the telescoping tube 25 to be locked into place. The means to secure the sections of tube may vary but a locking coupling or threaded clamp may be used as well as a tube with a series of holes into which protrusion would fit may also be contemplated.

The support structure 40, which are secured at the tee will rotate around the clamp 45 and will allow the first end of the telescoping pole 25 to be placed against a wall as depicted in FIGS. 3, 3A, 3B, 3C and 6. On the first end of the telescoping tube will be a base 30, which may be weighted for additional stability, and which will be secured against the baseboard of the wall 20. The shape of the pad 30 may be shaped to conform to the general shape of a baseboard. The base 30 may also be allowed to swivel at the end where it connects to the telescoping pole. This pad will ensure that, if the ladder slips backward, the movement of the ladder will be stopped in place.

In order to enable the device to be more versatile a swivel mechanism may be placed near the tee, which is joined to the support structure. The ability to swivel will enable the telescoping pole to be secured in many different positions.

In some environments the ladder is placed in a structure that does not provide a base board behind the ladder but instead an opening is behind the ladder. In that situation a base board member 22 can be installed in the opening and the pad rests against the base board member 22 such as depicted in FIG. 3*c*.

Figure 3:
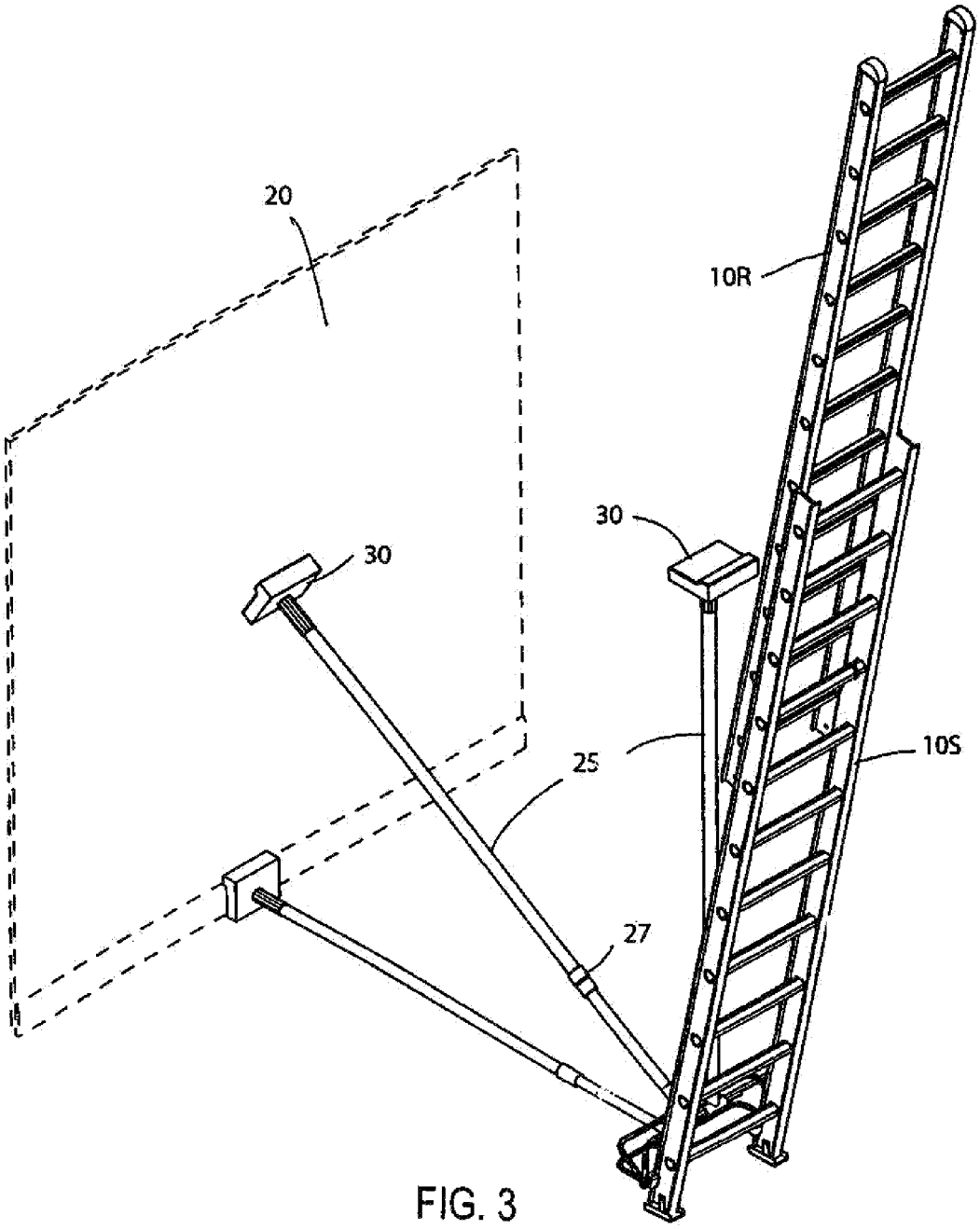
FIG. 3 is an isometric view of the device in use.
Figure 3A:
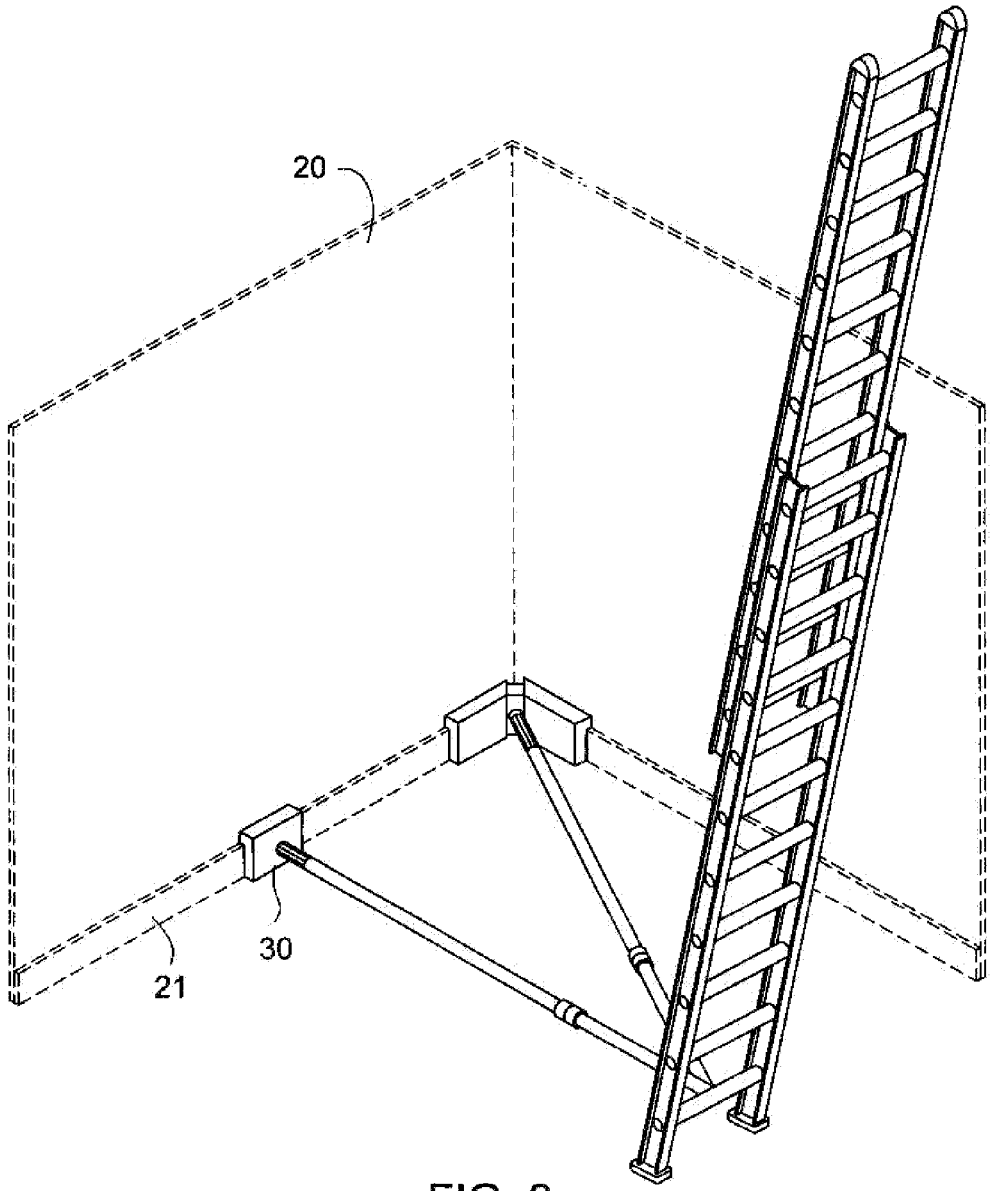
FIG. 3A is an isometric view of the device used against a baseboard and in the corner of the baseboard when doing corner work.
Figure 3B:
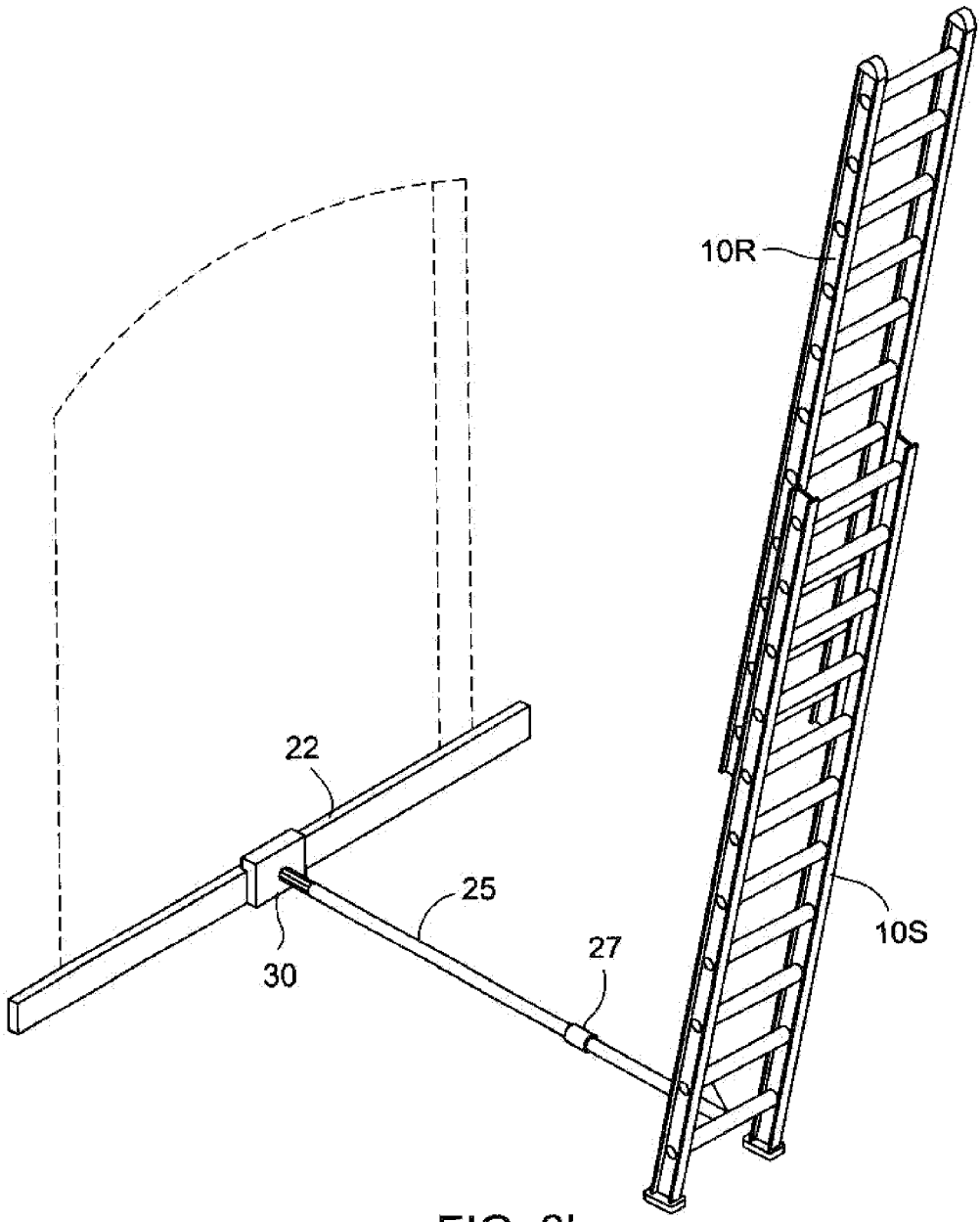
FIG. 3B is an isometric view of the device used with an archway.
Figure 3C:
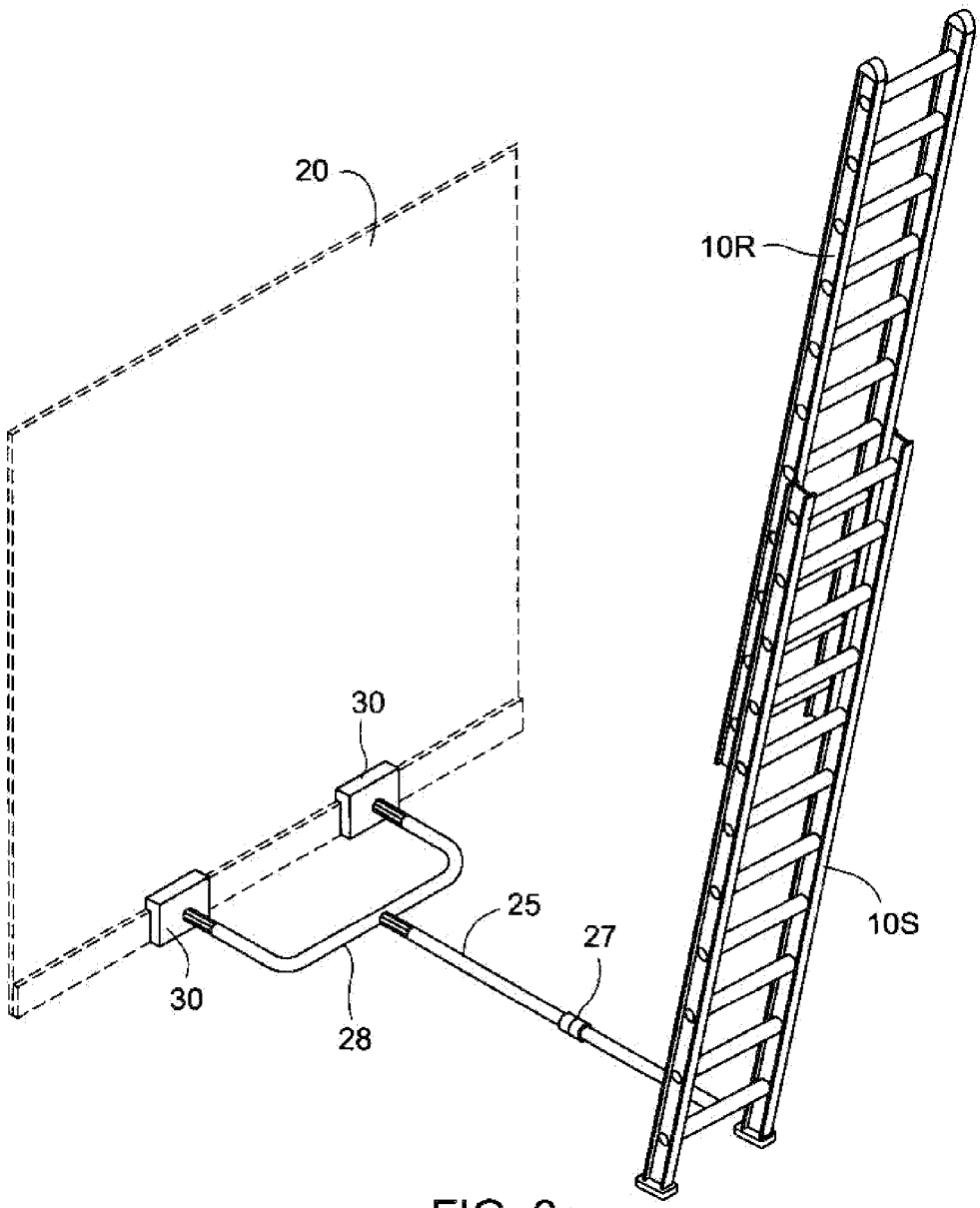
FIG. 3C is an isometric view of a double base pad embodiment to prevent flipping of the ladder.
Figure 4:
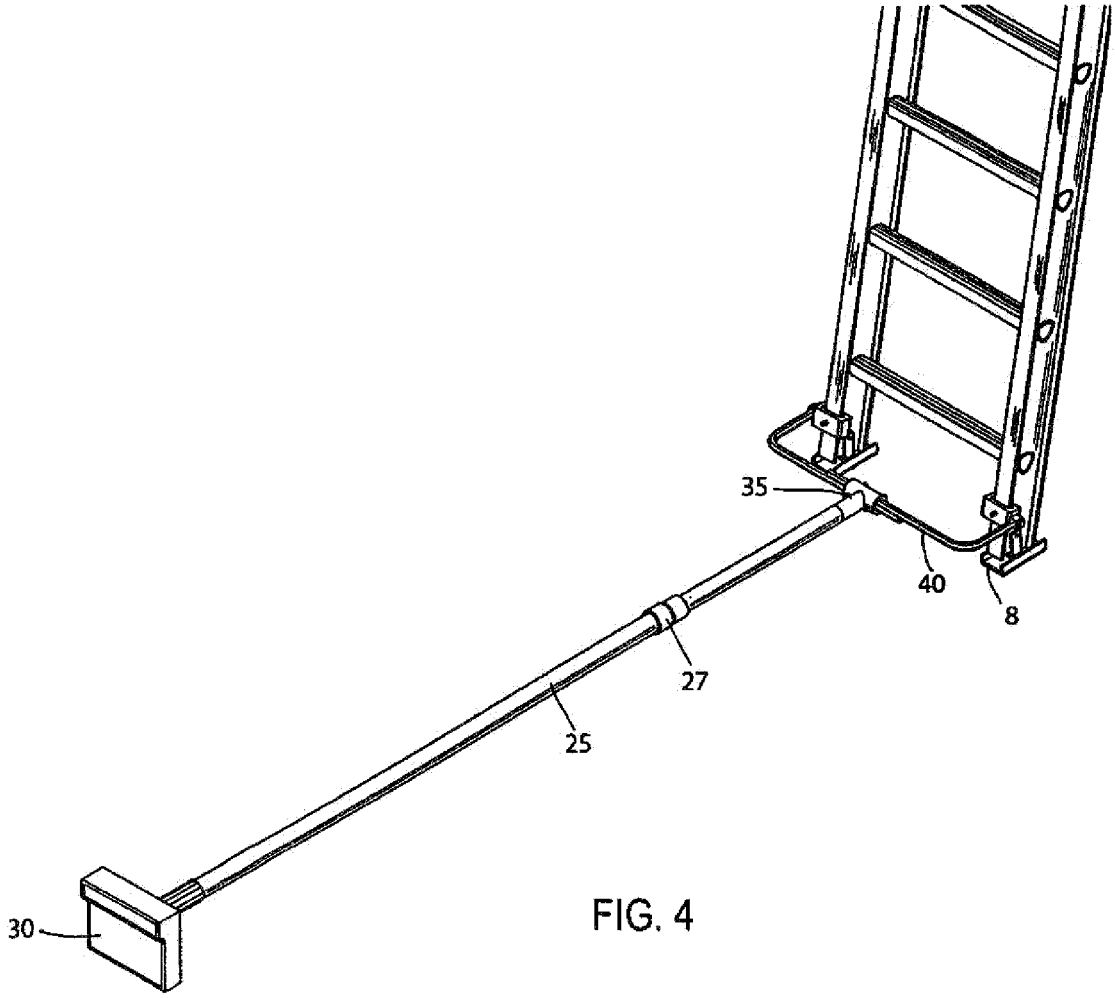
FIG. 4 is an isometric view of the device with the telescoping tube extended.
Figure 5:
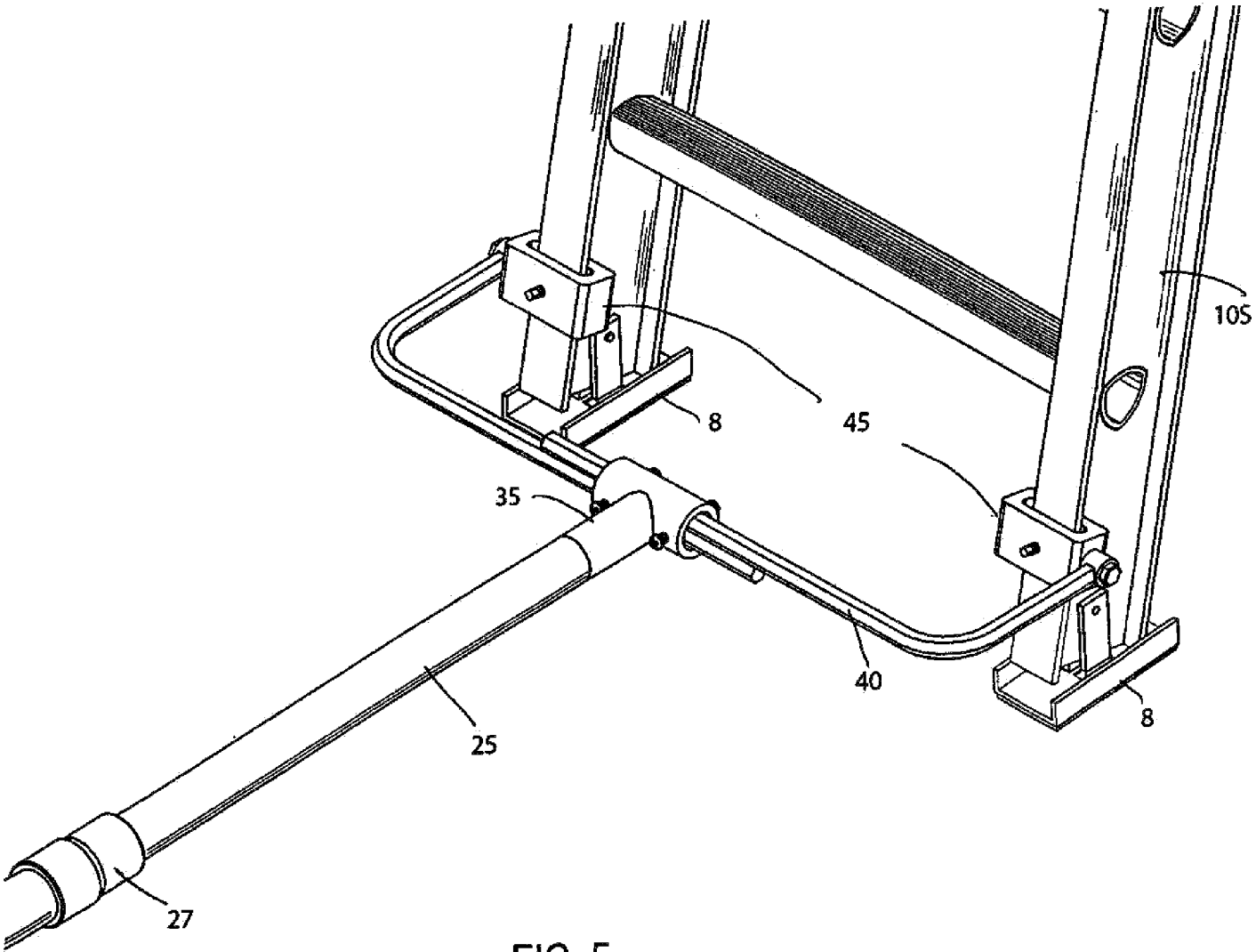
FIG. 5 is an isometric view of the clamping mechanism and support mechanism.
Figure 6:
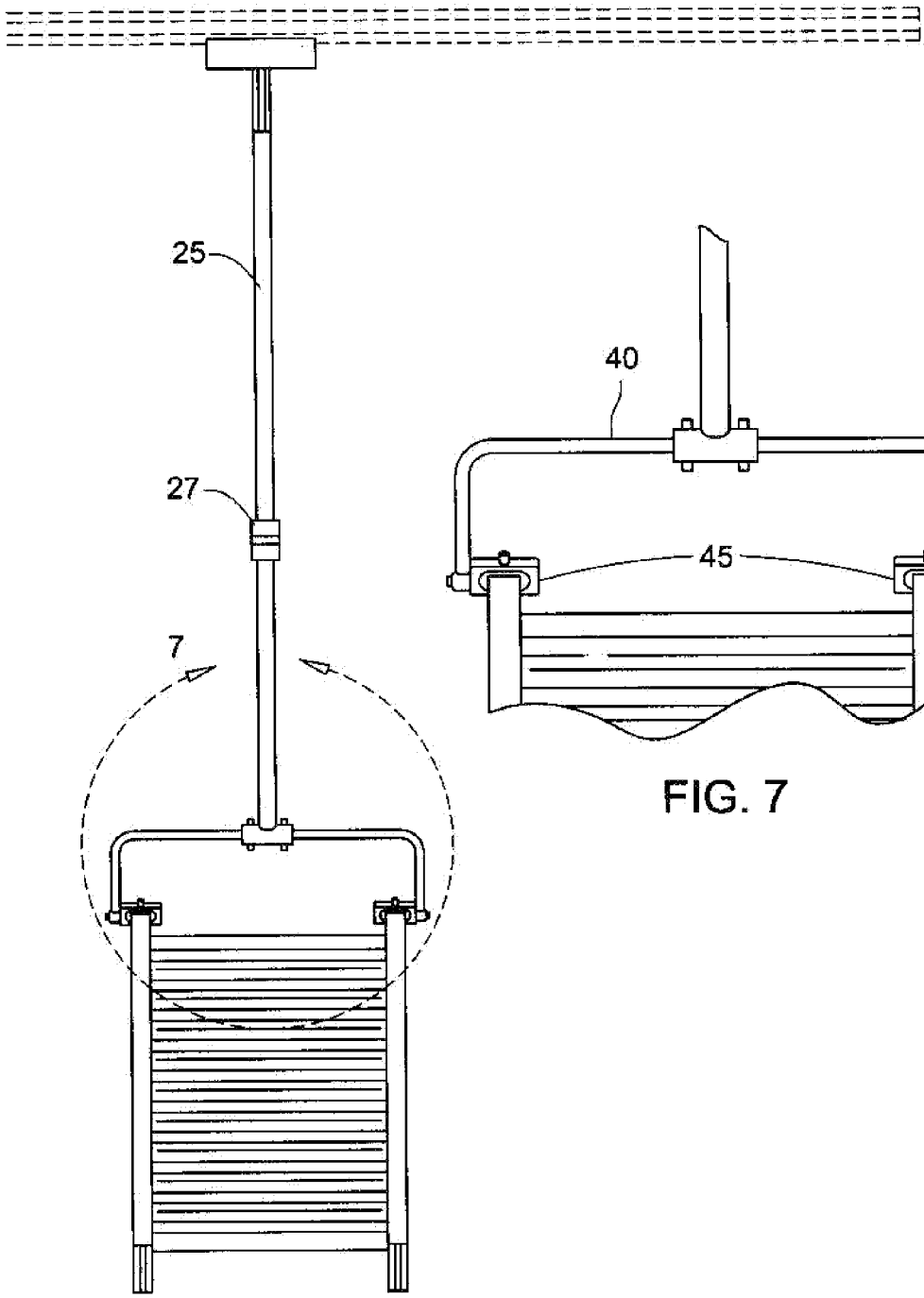
FIG. 6 is a top view of the device in use.
Figure 7:
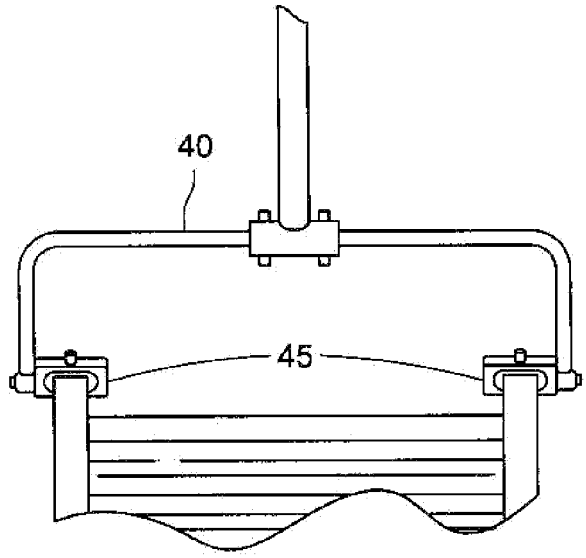
FIG. 7 is an exploded view of item 7 on FIG. 6.
Figure 9:
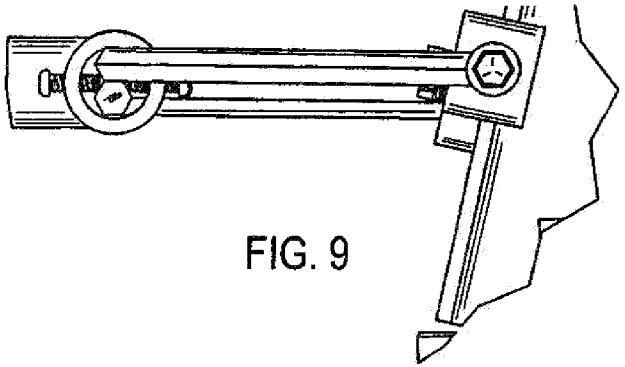
FIG. 9 is an exploded view of item 9 on FIG. 8.
Figure 8:
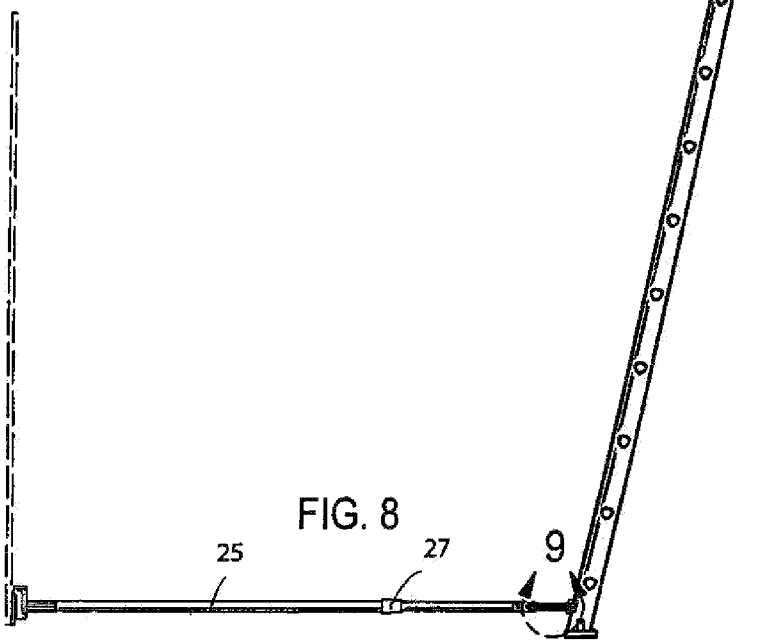
FIG. 8 is a side view of the device in use.
Figure 10:
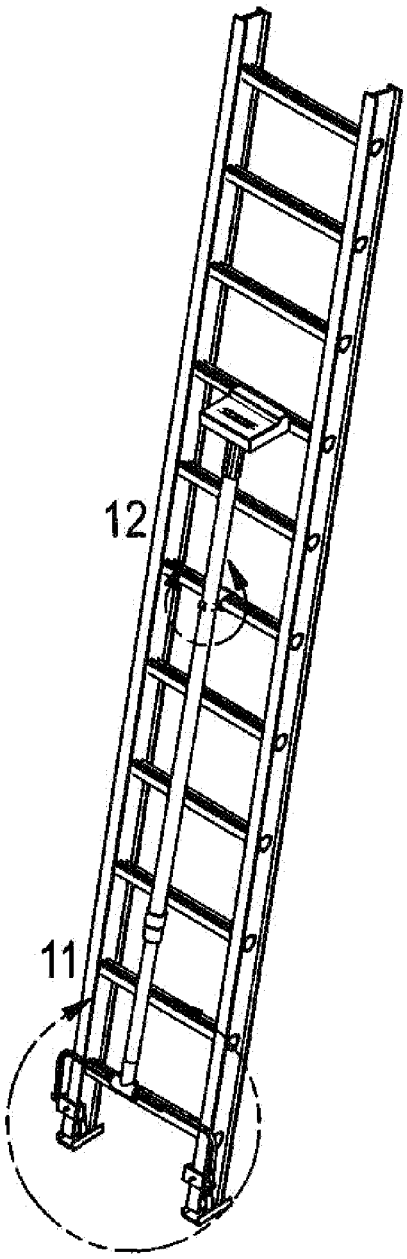
FIG. 10 is an isometric view of the device stowed.
Figure 12:
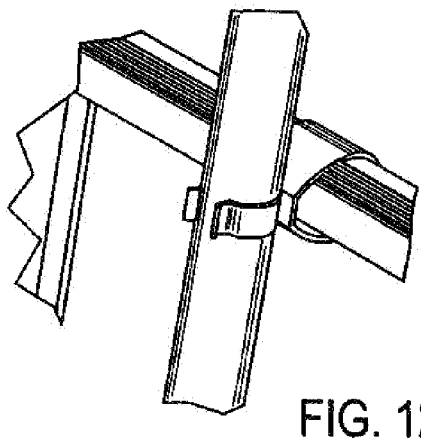
FIG. 12 is an exploded view of the clip on the ladder.
Figure 11:
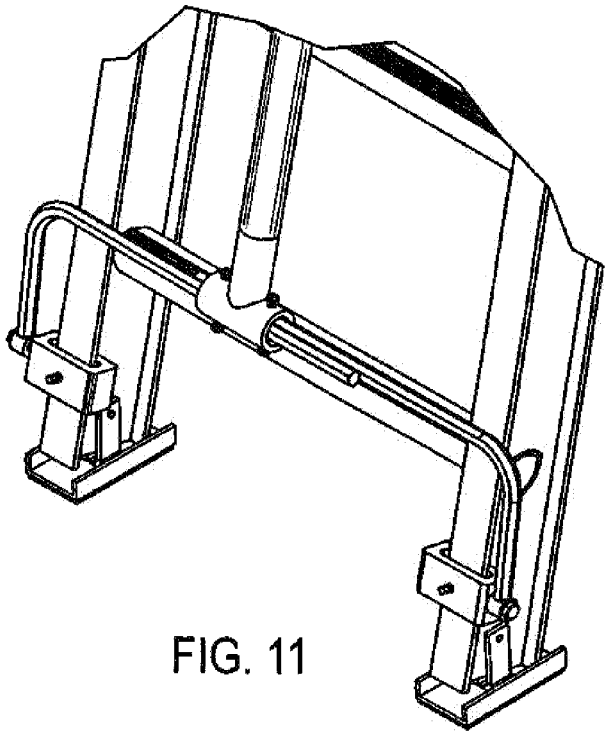
FIG. 11 is an exploded view of the clamping device as shown by the area in item 11 on FIG. 10.
Figure 13:
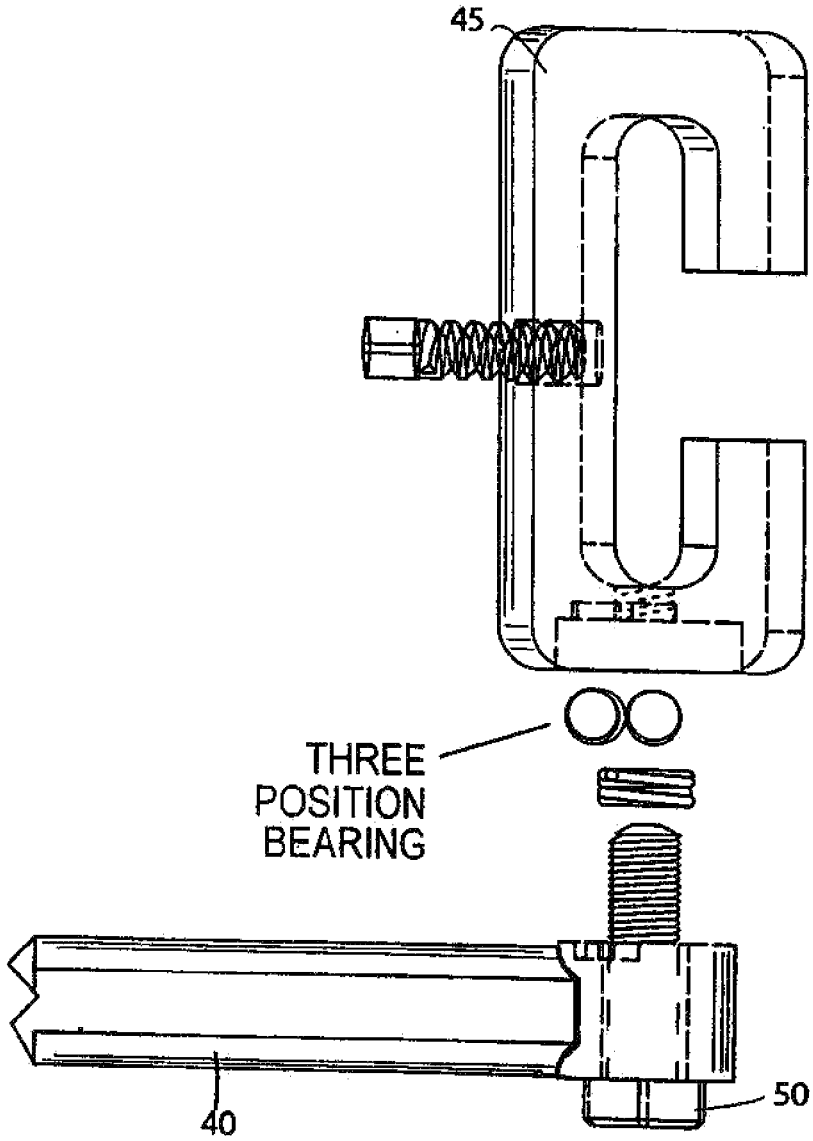
FIG. 13 is an exploded view of the bearing for the clamping mechanism.
Figure 14:
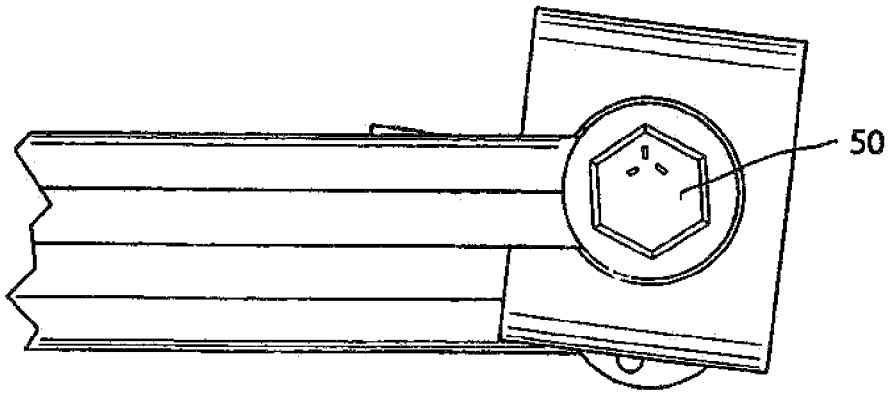
FIG. 14 is a side view of the clamping mechanism.
Figure 15:
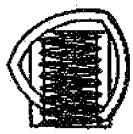
FIG. 15 is a view of the interior of the clamp on the ladder that holds the pole.
Figure 16:
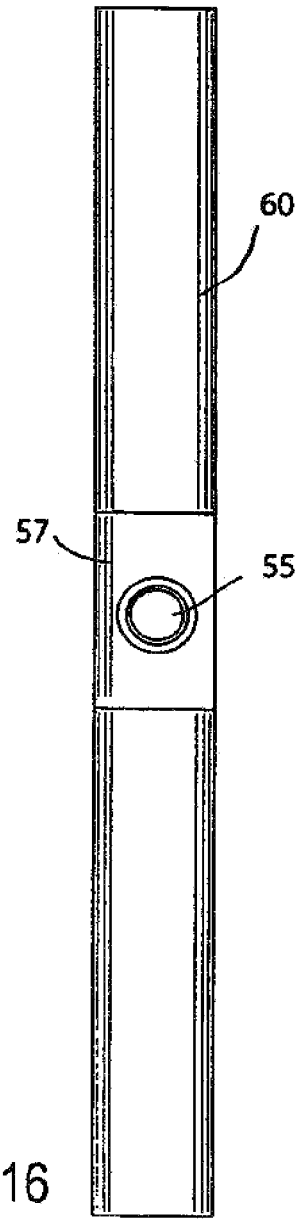
FIG. 16 is a front view of the alternative embodiment.
Figure 17:
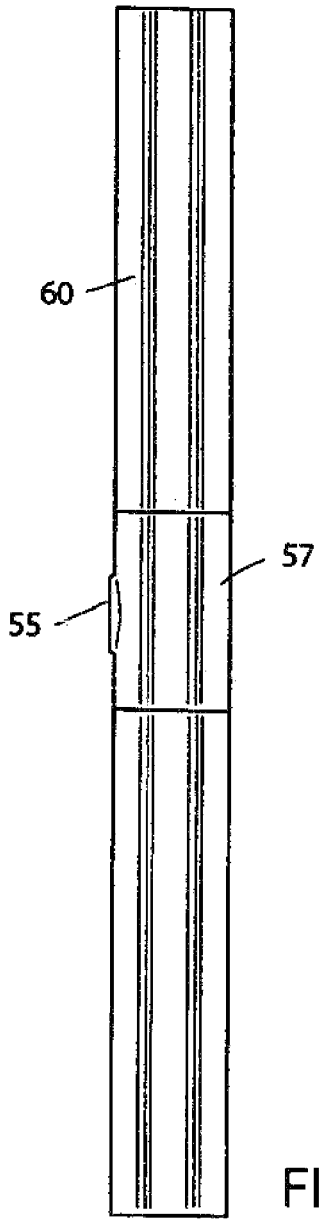
FIG. 17 is a top view of the alternative embodiment.
Figure 18:
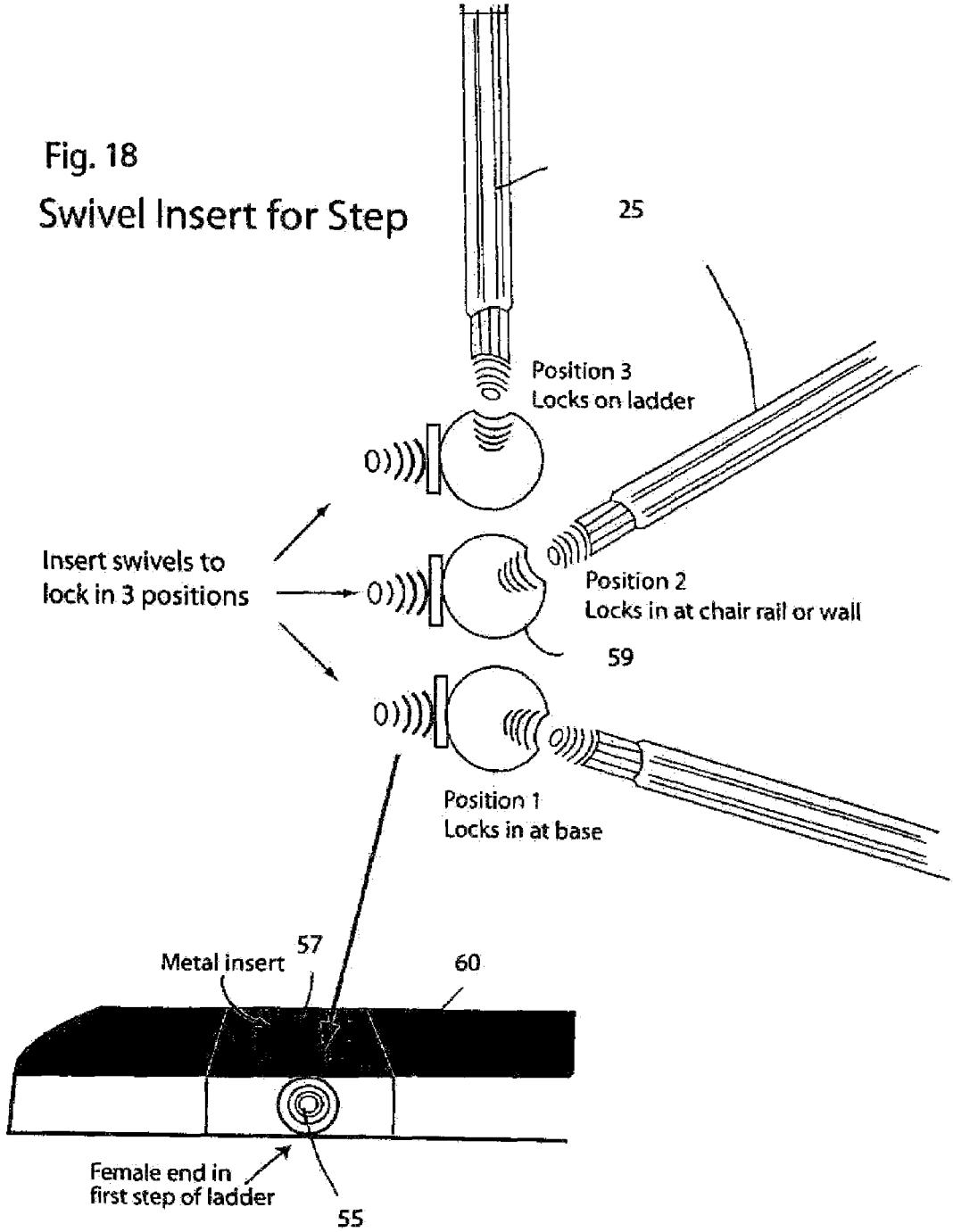
FIG. 18 is an isometric view of the swivel mechanism for the alternative embodiment demonstrating at least three possible positions of the pole: locked on the base, locked on the chair rail or wall and locked on the ladder.
Figure 19:
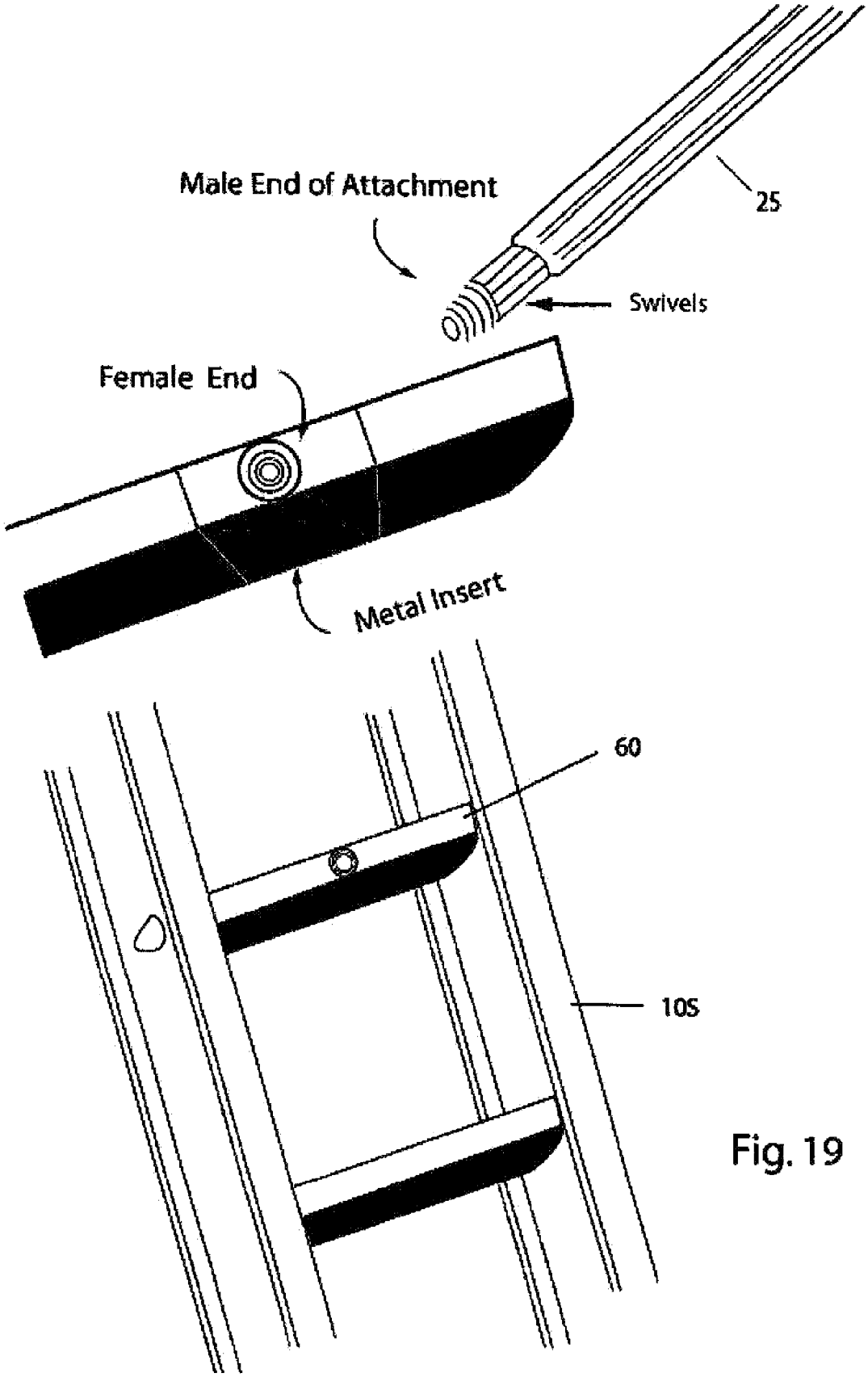
FIG. 19 is an isometric view of an alternative swivel mechanism for the second alternative embodiment depicting the ladder rung attachment as past of the existing ladder.

There may also be attached to one end of the telescoping tube a U shaped base member 28 that will accommodate two pads such as depicted in FIG. 3*c*. This particular arrangement will provide additional security for the device.

The tee 35 that is used to secure the support members together will likely come in two sections, which will clamp around the support structure members 40. The means of connection for the sections of the tee 35 are likely to be a bolt and nut 36 but other means to secure the sections of the tee may also be contemplated.

The clamping mechanism on the extension ladder leg 45 can also be of many different varieties, but it should clamp securely on the respective extension ladder legs and allow the support structure 40 to rotate so that the telescoping tube is able to position the pad 30 securely against the wall. The advantage to the use of clamps is the ability to change the positions on the ladder to accommodate different working conditions.

Figure 1:
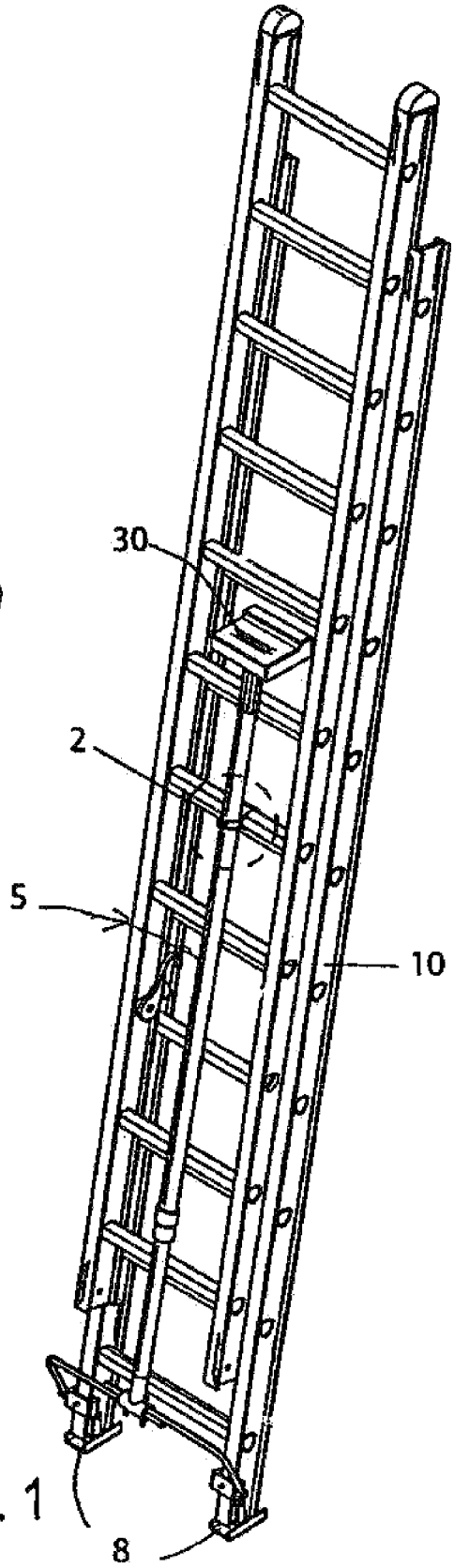
FIG. 1 is an isometric view of the device secured to the extension ladder.

For ease of storage, a clip 15 is provided on one rung of the extension ladder. When the device is stowed, it can be clipped as depicted in FIG. 1. Various materials may be used in the construction of this particular device, and certain safety considerations would be paramount.

A possible choice of materials may include aluminum, PVC pipe, or any other material that would provide sufficient strength in the event that the ladder may began to slip backward.

ALTERNATIVE EMBODIMENT

One of the salient features of this device is the method by which the device is secured to the extension ladder. A plurality of clamps may be used as described above in the first embodiment. Another alternative is to incorporate a female portion into the bottom rung of the extension ladder. A swivel mechanism is placed in the female end and the male end of the telescoping tube is installed in the swivel mechanism.

The device operates the same way with regard to rotating the telescoping tube to secure the device to the wall or baseboard. The advantage of installing the female end directly into the rung of the ladder is that it eliminates the clamping mechanisms.

The inventor claims:

1. A ladder lock system, which is comprised of:

a. an extension ladder;

wherein the extension ladder has a first member and a second member;

wherein the first member is stationary;

said first member rests on the ground surface;

wherein a plurality of legs are provided on the first member;

wherein a foot support is provided on the end of the legs;

wherein the second member moves relative to the first member;

wherein one end of the stationary member of the extension ladder has a foot support;

said foot support rests on the ground surface when the extension ladder is in use;

wherein a non-skid surface is placed on the foot support of the first member;

b. a plurality of clamps;

wherein a clamp is placed on each of the legs of the first member of the extension ladder;

wherein a means to secure the clamps is provided;

c. support structure;

wherein support structure members extend from the clamps;

wherein the support structure members takes the general shape of a U;

d. a tee;
said tee has a first end and a second end;
said first end is hollow;
wherein the support structure is secured to the first end of the tee;
wherein second end of the tee is equipped with a female end;
wherein a telescoping tube is secured to the female end of the tee;

e. a telescoping tube;
wherein the telescoping tube has a first end and a second end;
said first end is secured to the tee;
said second end secures a base member;
wherein the telescoping tube is secured to the tee;
wherein the second end of the telescoping tube rotates backwards when the device is deployed;

f. base member;
wherein a base member is secured to the second end of telescoping tube;
wherein a pad is placed on the base member;
wherein the pad of the base member is placed against a portion of the building structure behind the ladder;

g. a means to lock the telescoping tube;
wherein a means to lock the sections of the telescoping tube is provided;

h. clip;
wherein a clip is provided on the extension ladder;
said clip secures the device to the extension ladder.

2. The device as described in claim 1 wherein the base member is essentially rectangular.

3. The device as described in claim 1 wherein the base member is weighted.

4. The device as described in claim 1 wherein the base member is in the general shape of a base board.

5. The device as described in claim 1 wherein the base member is in the general shape of a chair rail.

6. The device as described in claim 1 wherein the means to lock the telescoping tube is a coupling.

7. The device as described in claim 1 wherein the means of connection for the tee structure is a bolt.

8. A ladder lock system, which is comprised of:

a. an extension ladder;
wherein the extension ladder has a first member and a second member;
wherein the first member is stationary;
said first member rests on the ground surface;
wherein a plurality of legs are positioned on the first member;
wherein a foot support is placed on the end of the legs;
said foot supports rest on the ground surface;
wherein the second member moves relative to the first member;
wherein a non-skid surface is placed on the foot support;

b. means to secure the ladder lock system to a rung of the extension ladder;
wherein a female portion is provided on a rung of the extension ladder;
wherein a telescoping tube is secured to said female portion;
said telescoping tube is allowed to swivel;

c. swivel;
wherein a swivel mechanism is provided;

d. a telescoping tube;
wherein a telescoping tube extends outward from the swivel mechanism;
wherein the telescoping tube has a first end and a second end;
said first end is secured to the swivel mechanism;
said second end secures a base member;
wherein the telescoping tube is secured to the swivel mechanism;
wherein the second end of the telescoping tube rotates backwards when the device is deployed;

e. base member;
wherein a base member is secured to the second end of the telescoping tube;
wherein a pad is placed on the base member;
wherein the pad of the base member is placed against a portion of the building structure behind the ladder;

e. a means to secure the telescoping tube;
wherein a means to lock the sections of the telescoping tube is provided;

f. clip;
wherein a clip is provided on the ladder;
said clip secures the device to the ladder.

9. The device as described in claim 8 wherein the base member is essentially rectangular.

10. The device as described in claim 8 wherein the means to lock the telescoping tube is a coupling.

11. The device as described in claim 8 wherein the means of connection for the tee structure is a bolt.

12. The device as described in claim 8 wherein the female rung attachment is manufactured as part of the ladder.

* * * * *